US008346137B2

(12) United States Patent
Gyoutoku et al.

(10) Patent No.: US 8,346,137 B2
(45) Date of Patent: Jan. 1, 2013

(54) DEVELOPING DEVICE AND IMAGE-FORMING APPARATUS PROVIDED THEREWITH

(75) Inventors: Eiji Gyoutoku, Osaka (JP); Koju Yamamoto, Osaka (JP); Norio Kubo, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 203 days.

(21) Appl. No.: 12/849,373

(22) Filed: Aug. 3, 2010

(65) Prior Publication Data

US 2011/0052270 A1 Mar. 3, 2011

(30) Foreign Application Priority Data

Aug. 26, 2009 (JP) ..... 2009-194976
Aug. 26, 2009 (JP) ..... 2009-194978

(51) Int. Cl.
*G03G 15/09* (2006.01)

(52) U.S. Cl. ..... 399/273; 399/274

(58) Field of Classification Search ..... 399/273, 399/274

See application file for complete search history.

(56) References Cited

U.S. PATENT DOCUMENTS 4,731,632 A * 3/1988 Fukushima et al. ..... 399/273
4,963,930 A 10/1990 Yoshimaru et al.
7,583,916 B2 9/2009 Ogata et al.
7,917,046 B2 3/2011 Kubo

FOREIGN PATENT DOCUMENTS

CN 1619434 A 5/2005
CN 101334613 A 12/2008
JP 2-139587 5/1990
JP 2006-250973 9/2006

* cited by examiner

*Primary Examiner* — Hoang Ngo
(74) *Attorney, Agent, or Firm* — Smith, Gambrell & Russell, LLP

(57) ABSTRACT

A developing device includes a developing container for accommodating a two-component developer; a developer bearing member for bearing and conveying the developer, a fixed magnet including a release pole for releasing the developer from the developer bearing member, being fixed to the inside of the developer bearing member; and a backflow prevention member that is a sheet-shaped member disposed along the entire length in the longitudinal direction of the developer bearing member so as to be upstream in the direction of rotation of the developer bearing member as viewed from the release pole, the backflow prevention member being disposed so that a proximal end portion thereof is fixed to an inside surface of the developing container, and a distal end portion thereof is in contact with or adjacent to the developer bearing member and facing downstream in the direction of rotation of the developer bearing member.

18 Claims, 12 Drawing Sheets

DEVELOPING DEVICE AND IMAGE-FORMING APPARATUS PROVIDED THEREWITH

BACKGROUND

The present application is based on Japanese Patent Application No. 2009-194976 filed on Aug. 26, 2009, and Japanese Patent Application No. 2009-194978, filed on Aug. 26, 2009, the contents of which are hereby incorporated by reference.

TECHNICAL FIELD

The present disclosure relates to a developing device installed in an image-forming apparatus such as a photocopier, a facsimile machine, and a printer, and to an image-forming apparatus that is provided with the developing device. In particular, the present disclosure relates to a developing device that uses a two-component developer composed of a magnetic carrier and a toner.

DESCRIPTION OF THE RELATED ART

Conventionally known developing methods involving the use of a dry toner in an image-forming apparatus in which an electrophotographic process are used include one-component developing methods in which a carrier is not used, and two-component developing methods in which a two-component developer composed of a magnetic carrier (also referred to simply as a carrier) and a toner that is electrostatically charged by the magnetic carrier is used to develop an electrostatic latent image on a photoreceptor through the use of magnetic brushes composed of toner and carrier formed on a developing roller.

In image-forming apparatus that use a two-component developing method, the developing device filled with the developer is often shipped from the factory already installed in the main body of the image-forming apparatus in order to minimize the amount of packaging materials or paddings in light of the environmental burden. Measures are therefore taken to enhance the sealing properties of the developing device so that overturning, dropping, and other adverse events during transport do not cause the developer to leak out.

As a result of the increased drive speed of stirring mixers and other devices rotating inside the developing device in concert with the recent increase in image processing speeds, the movement speed of the developer inside the developing device has also increased. If the sealing properties of the developing device are enhanced in order to prevent leakage of the developer, the fact that the air pressure of the space inside the developing device also increases when the developing device is driven means that toner that has fallen into the developing device from a supply device will be retained in a space higher than the developer surface in the developing device by the air pressure, and this leads to the problem of unstable feeding of toner. Particularly near the end of the service life of the developing device, in a state in which the ability to charge the toner by the carrier has declined, temporary defects in the charging of the toner occur due to such causes as the retained toner falling all at once into the developing device, and fogging can occur in the image that is formed on the paper.

Methods have been proposed for reducing the increase in pressure inside the developing device, and there have been disclosed developing devices, for example, in which pressure increase and developer leakage are suppressed by providing a pressure relief hole at the top of the housing of the developing device and also covering the pressure relief hole with a filter.

SUMMARY

However, in the method described above, the effects for reducing the pressure inside the developing device are reduced by clogging of the filter in cases in which the developing device has a long service life. In cases in which the developing device filled with the developer is shipped already installed in the main body of the image-forming apparatus, there is a risk of the developer leaking out of the developing device through the filter and contaminating the inside of the image-forming apparatus when the image-forming apparatus is overturned or dropped during transport.

In view of the problems described above, an object of the present disclosure is to provide a two-component developing-type developing device and an image-forming apparatus provided therewith, whereby there is no increase in the air pressure of the space inside the developing device even in cases in which the image processing speed is increased, and it is possible to suppress leakage of the developer from within the developing device due to impact from overturning or dropping during transport.

The developing device according to a first aspect of the present disclosure for achieving the abovementioned objects includes a developing container configured to accommodate a two-component developer that includes a toner and a magnetic carrier; a stirring/conveyance member configured to stir and convey the developer accommodated in the developing container; a developer bearing member configured to bear and convey the developer, the developer bearing member being disposed so as to be able to rotate above the stirring/conveyance member; a fixed magnet configured to have a plurality of magnetic poles that includes a release pole for releasing the developer from a surface of the developer bearing member, the fixed magnet being fixed in the inside of the developer bearing member; a regulating blade configured to be disposed facing the developer bearing member so as to be downstream side in the direction of rotation of the developer bearing member as viewed from the release pole; and a back-flow prevention member that is a sheet-shaped member configured to be disposed along the entire length in the longitudinal direction of the developer bearing member so as to be upstream side in the direction of rotation of the developer bearing member as viewed from the release pole, being disposed so that a proximal end portion thereof is fixed to an inside surface of the developing container, and a distal end portion thereof is in contact with or adjacent to the developer bearing member and facing downstream side in the direction of rotation of the developer bearing member.

Other objects of the present disclosure and specific advantages gained by the present disclosure will become clear from the following description of embodiments of the present disclosure.

DETAILED DESCRIPTION OF PREFERRED EMBODIMENTS

Figure 1:
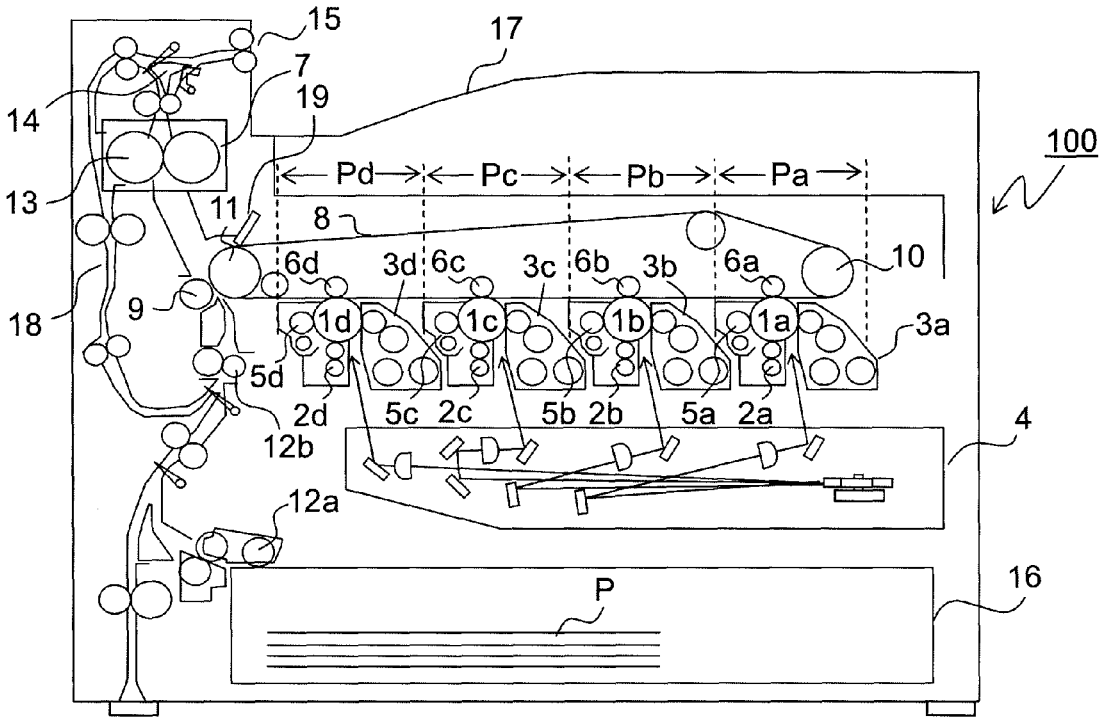
FIG. 1 is a schematic view showing the overall structure of an image-forming apparatus equipped with a developing device according to an embodiment.

Embodiments will next be described with reference to the drawings. FIG. 1 is a schematic sectional view showing an image-forming apparatus 100 equipped with a developing device according to an embodiment, and shows a tandem-type color image-forming apparatus in this case. Four image forming units Pa, Pb, Pc, and Pd are arranged in sequence from the right side of FIG. 1 in the main body of the color image-forming apparatus 100. The image forming units Pa, Pb, Pc, and Pd are provided so as to correspond to images of four different colors (cyan, magenta, yellow, and black), and sequentially form cyan, magenta, yellow, and black images, respectively, by the steps of charging, exposure, developing.

Photoconductive drums 1*a*, 1*b*, 1*c*, and 1*d* on which visible images (toner images) of each color are formed on the surfaces thereof are provided to the image forming units Pa, Pb, Pc, and Pd, respectively, and an intermediate transfer belt 8 that is caused to rotate clockwise in FIG. 1 by driving means (not shown) is furthermore provided adjacently to the image forming units Pa, Pb, Pc, and Pd. The toner images formed on the photoconductive drums 1*a*, 1*b*, 1*c*, and 1*d* are sequentially transferred onto the intermediate transfer belt 8 that moves while making contact with each of the photoconductive drums 1*a*, 1*b*, 1*c*, and 1*d*, respectively, and the toner images are superposed on each other before being transferred onto a transfer paper P as an example of a recording medium by the action of a secondary transfer roller 9. After the toner images transferred onto the transfer paper P are fixed to the transfer paper P in a fixing unit 7, the transfer paper P having the toner images fixed thereon is discharged from the main body of the apparatus. The image forming process for each photoconductive drum 1*a*, 1*b*, 1*c*, and 1*d* is executed while the photoconductive drums 1*a*, 1*b*, 1*c*, and 1*d* are caused to rotate counterclockwise in FIG. 1.

The transfer paper P onto which the toner images are transferred is accommodated in a paper cassette 16 disposed in the lower part of the color image-forming apparatus. During image formation, the transfer paper P is conveyed through a pair of resist rollers 12*b* toward a nip between the secondary transfer roller 9 and a drive roller 11 of the intermediate transfer belt 8 described hereinafter. A dielectric resin sheet is used as the intermediate transfer belt 8. A blade-shaped belt cleaner 19 for removing the toner that remains on the surface of the intermediate transfer belt 8 is disposed downstream side in the movement direction of the intermediate transfer belt 8 as viewed from the secondary transfer roller 9.

The image forming units Pa, Pb, Pc, and Pd will next be described. Charging devices 2*a*, 2*b*, 2*c*, and 2*d* for electrostatically charging the photoconductive drums 1*a*, 1*b*, 1*c*, and 1*d* respectively; an exposure unit 4 for exposing the photoconductive drums 1*a*, 1*b*, 1*c*, and 1*d* with image information and forming electrostatic latent images on the photoconductive drums 1*a*, 1*b*, 1*c*, and 1*d*; developing devices 3*a*, 3*b*, 3*c*, and 3*d* for forming toner images on the photoconductive drums 1*a*, 1*b*, 1*c*, and 1*d* by developing the electrostatic latent images formed on the photoconductive drums 1*a*, 1*b*, 1*c*, and 1*d*, respectively; and cleaning devices 5*a*, 5*b*, 5*c*, and 5*d* for respectively removing the developer (toner) that remains on the photoconductive drums 1*a*, 1*b*, 1*c*, and 1*d* are provided on the periphery of and below the photoconductive drums 1*a*, 1*b*, 1*c*, and 1*d*, which are provided so as to be able to rotate.

When image data are inputted from a PC or other upper-level device connected to the color image-forming apparatus 100, the surfaces of the photoconductive drums 1*a*, 1*b*, 1*c*, and 1*d* are first uniformly charged by the charging devices 2*a*, 2*b*, 2*c*, and 2*d*, respectively, then irradiated with light corresponding to the image data by the exposure unit 4; and an electrostatic latent image corresponding to the image data is formed on each of the photoconductive drums 1*a*, 1*b*, 1*c*, and 1*d*, respectively. The developing devices 3*a*, 3*b*, 3*c*, and 3*d* are each filled with a predetermined quantity of a two-component developer that includes toner in each of the colors of cyan, magenta, yellow, and black, respectively. The developing devices 3*a*, 3*b*, 3*c*, and 3*d* are replenished with toner from a toner replenishing device (not shown) in a case in which the ratio of toner in the two-component developer stored in the developing devices 3*a*, 3*b*, 3*c*, and 3*d* decreases below a specified value as a result of the forming of the toner images described hereinafter, respectively. The toners in the developers are fed onto the photoconductive drums 1*a*, 1*b*, 1*c*, and 1*d* by the developing devices 3*a*, 3*b*, 3*c*, and 3*d* and electrostatically absorbed, thereby forming toner images that corresponds to the electrostatic latent images formed by exposure by the exposure unit 4.

Electric fields are created by a predetermined transfer voltage between primary transfer rollers 6*a*, 6*b*, 6*c*, and 6*d* and the photoconductive drums 1*a*, 1*b*, 1*c*, and 1*d* by the primary transfer rollers 6*a*, 6*b*, 6*c*, and 6*d*, respectively; and the yellow, cyan, magenta, and black toner images on the photoconductive drums 1*a*, 1*b*, 1*c*, and 1*d* undergo a primary transfer onto the intermediate transfer belt 8, respectively. These four color toner images are formed with a corresponding positional relationship that is determined in advance in order to form a full-color image. The toner remaining on the surfaces of the photoconductive drums 1*a*, 1*b*, 1*c*, and 1*d* is then removed by the cleaning devices 5*a*, 5*b*, 5*c*, and 5*d*, respectively in preparation for subsequent formation of new electrostatic latent images.

The intermediate transfer belt 8 is extended across a driven roller 10 on the upstream side and a drive roller 11 on the downstream side, and when the intermediate transfer belt 8 begins to rotate clockwise as the drive roller 11 is caused to rotate by a drive motor (not shown), the transfer paper P is conveyed at a predetermined timing from the pair of resist rollers 12*b* toward the nip between the drive roller 11 and the secondary transfer roller 9 adjoining to the intermediate transfer belt 8; and the full-color image is transferred onto the transfer paper P. The transfer paper P onto which the full-color toner image is transferred is conveyed toward the fixing unit 7.

The transfer paper P conveyed to the fixing unit 7 is heated and pressed by a pair of fixing rollers 13, the toner image is fixed to the surface of the transfer paper P, and a full-color image is formed. The direction of conveyance of the transfer paper P on which the full-color image is formed is divided by a branching unit 14 that is branched in a plurality of directions. In cases in which an image is formed on only one side of the transfer paper P, the transfer paper P is directly discharged to a discharge tray 17 by a pair of discharge rollers 15.

On the other hand, when images are formed on both sides of the transfer paper P, a portion of the transfer paper P having passed through the fixing unit 7 is caused to temporarily protrude to the outside of the image-forming apparatus 100 from the pair of discharge rollers 15. The transfer paper P is then sent to a paper conveyance path 18 by the branching unit 14 by causing the pair of discharge rollers 15 to rotate in the opposite direction, and the transfer paper P is conveyed back to the pair of resist rollers 12*b* in a state in which the image surface is reversed. A subsequent image formed on the intermediate transfer belt 8 is then transferred by the secondary transfer roller 9 onto the surface of the transfer paper P on which an image were not yet formed, and the transfer paper P is conveyed to the fixing unit 7 to fix the toner image, thereafter the transfer paper P is discharged to the discharge tray 17 from the pair of discharge rollers 15.

Figure 2:
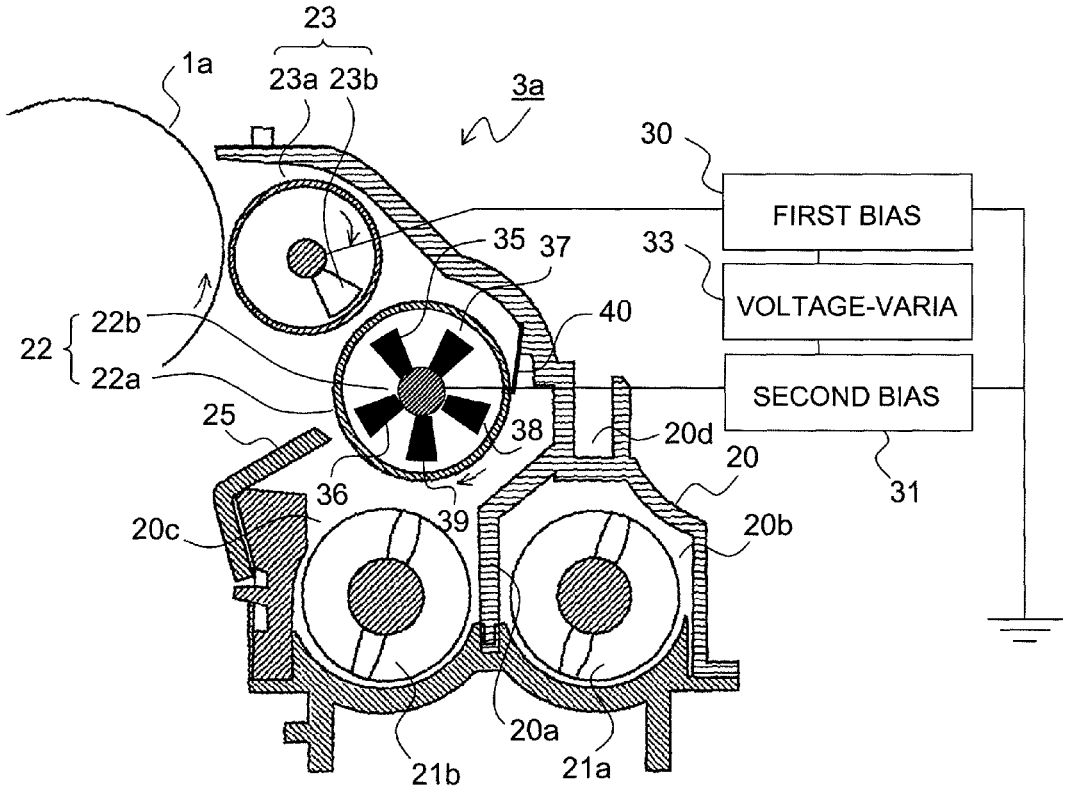
FIG. 2 is a sectional side view showing an example of the structure of the developing device according to an embodiment.

FIG. 2 is a sectional side view showing the structure of the developing device according to an embodiment. The developing device 3*a* disposed in the image forming unit Pa of FIG. 1 is described below, but because the basic structure thereof is the same as those of the developing devices 3*b*,3*c* and 3*d* disposed in the image forming units Pb,Pc and Pd, the descriptions of the developing devices 3*b*, 3*c* and 3*d* are omitted.

As shown in FIG. 2, the developing device 3*a* is provided with a developing container 20 in which a two-component developer (also referred to hereinafter simply as developer) is accommodated, the developing container 20 is partitioned into first and second stirring chambers 20*b*, 20*c* by a partition wall 20*a*, and a first stirring screw 21*a* and second stirring screw 21*b* for mixing the toner (positively charged toner in this case) fed from a toner container (not shown) with a carrier, and agitating the mixture and charging the toner are rotatably provided in the first and second stirring chambers 20*b*, 20*c*, respectively. The first stirring screw 21*a* and second stirring screw 21*b* constitute the stirring/conveyance member.

The developer is conveyed in the axial direction while being stirred by the first stirring screw 21*a* and second stirring screw 21*b*, and is circulated between the first and second stirring chambers 20*b*, 20*c* through developer passages (not shown) that is formed in the partition wall 20*a*. In the example shown in the drawing, the developing container 20 extends to the top left side, inside the developing container 20, a magnetic roller 22 is disposed above the second stirring screw 21*b*, and a developing roller 23 is disposed in a top left side of the magnetic roller 22 so as to face the magnetic roller 22. The developing roller 23 faces the photoconductive drum 1*a* on the open side (left side in FIG. 2) of the developing container 20, and the magnetic roller 22 and developing roller 23 rotate clockwise in the drawing about the respective rotational axes thereof.

A toner concentration sensor (not shown) is provided on the developing container 20 so as to face the first stirring screw 21*a*, and the developing container 20 is replenished with toner through a toner replenishment port 20*d* from a replenishing device (not shown) according to the toner concentration detected by the toner concentration sensor.

The magnetic roller 22 is composed of a non-magnetic rotary sleeve 22*a* (developer bearing member) and a fixed magnet 22*b*, having a plurality of magnetic poles, that is disposed within the rotary sleeve 22*a*. In the present embodiment, the fixed magnet 22*b* has five magnetic poles; namely a main pole 35, a regulating pole (magnetic pole for recovery) 36, a conveyance pole 37, a release pole 38, and an uptake pole 39.

A regulating blade 25 is attached to the developing container 20 along the longitudinal direction (the direction perpendicular to the plane of the page on which FIG. 2 is shown) of the magnetic roller 22, and the regulating blade 25 is positioned upstream side in the rotation direction (clockwise in the drawing) of the magnetic roller 22 viewed from the position at which the developing roller 23 and magnetic roller 22 face each other. A slight gap is formed between the distal end portion of the regulating blade 25 and the surface of the magnetic roller 22.

The developing roller 23 is composed of a cylindrical developing sleeve 23*a* and a developing-roller-side magnetic pole 23*b* that is fixed inside the developing sleeve 23*a*, and the magnetic roller 22 and the developing roller 23 face each other having a predetermined gap in the facing position (opposing position) thereof. The developing-roller-side magnetic pole 23*b* has a different polarity from the magnetic pole (main pole) 35 of the fixed magnet 22*b* that faces the developing roller-side magnetic pole 23*b*.

A first bias circuit 30 for applying a direct current (hereinafter referred to as Vslv (DC)) and an alternating current (hereinafter referred to as Vslv (AC)) to the developing roller 23, is connected to the developing roller 23, and a second bias circuit 31 for applying a direct current (hereinafter referred to as Vmag (DC)) and an alternating current (hereinafter referred to as Vmag (AC)) to the magnetic roller 22, is connected to the magnetic roller 22. The first bias circuit 30 and the second bias circuit 31 are connected to a common ground.

A voltage-variable device 33 is connected to the first bias circuit 30 and the second bias circuit 31 and configured so as to be able to vary the Vslv (DC), Vslv (AC) applied to the developing roller 23 and the Vmag (DC), Vmag (AC) applied to the magnetic roller 22, respectively.

As previously described, the developer is circulated through the developing container 20 while being stirred by the first stirring screw 21*a* and second stirring screw 21*b* with the toner being electrostatically charged, and conveyed to the magnetic roller 22 by the second stirring screw 21*b*. Since the regulating pole 36 of the fixed magnet 22*b* faces the regulating blade 25, by using a non-magnetic body or a magnetic body having a different polarity from the regulating pole 36 as the regulating blade 25, a magnetic field is formed whereby the rotary sleeve 22*a* and the distal end of the regulating blade 25 attract each other in the gap therebetween.

This magnetic field forms a magnetic brush between the regulating blade 25 and the rotary sleeve 22*a*. After the thickness of the magnetic brush on the magnetic roller 22 is restricted by the regulating blade 25, when the rotation of the rotary sleeve 22*a* moves the magnetic brush to the position opposite the developing roller 23, an attracting magnetic field created by the developing-roller-side magnetic pole 23*b* and the main pole 35 of the fixed magnet 22*b* is given to the magnet brush, and the magnetic brush therefore makes contact with the surface of the developing roller 23. A thin layer of toner is then formed on the developing roller 23 by the magnetic field and the potential difference ΔV between Vmag (DC) applied to the magnetic roller 22 and Vslv (DC) applied to the developing roller 23.

The thickness of the toner layer on the developing roller 23 varies according to factors such as the resistance of the developer, the difference in rotation speed between the magnetic roller 22 and the developing roller 23, but can be controlled by ΔV. The bigger ΔV is, the thicker the thickness of the toner layer on the developing roller 23 is. And the smaller ΔV is, the thinner the thickness of the toner layer on the developing roller 23 is. The appropriate range of ΔV at the time of development is usually about 100V to 350V.

Figure 3A:
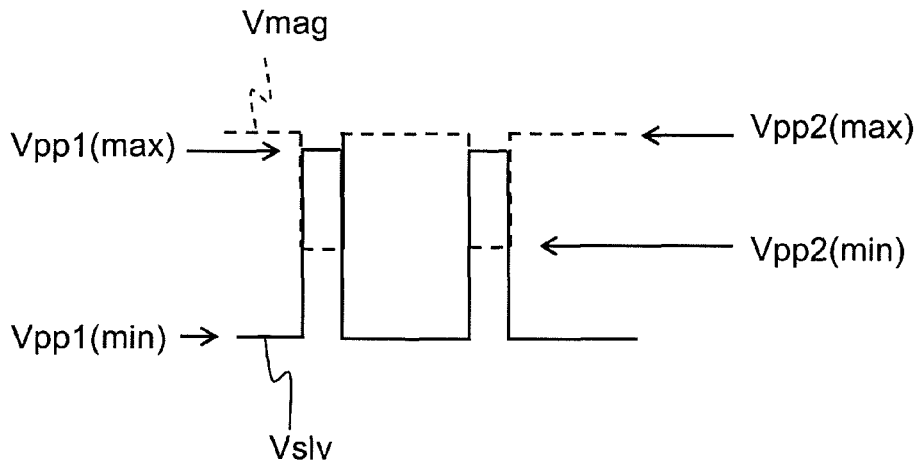
FIG. 3 is a view showing an example of the bias waveform applied to the developing roller and a magnetic roller.

FIG. 3 is a view showing examples waveform of the biases applied to the developing roller 23 and the magnetic roller 22. As shown in FIG. 3A, a synthetic waveform Vslv (solid line) composed of a Vslv (DC) and a rectangular wave Vslv (AC) having a peak-to-peak value of Vpp1 is applied to the developing roller 23 from the first bias circuit 30. A synthetic waveform Vmag (dashed line) composed of a Vmag (DC) and a rectangular wave Vmag (AC) having a peak-to-peak value of Vpp2 and a different phase from the Vslv (AC) is applied to the magnetic roller 22 from the second bias circuit 31.

Figure 3B:
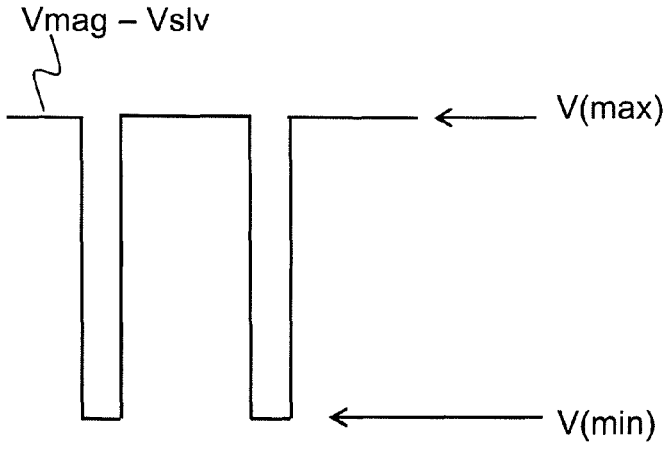

Consequently, the voltage applied to the gap between the magnetic roller 22 and the developing roller 23 (referred to as MS hereinafter) is a synthetic waveform Vmag-Vslv having a Vpp (max) and Vpp (min) as shown in FIG. 3B. It is noted that the Vmag (AC) is set so as to have a higher duty ratio than the Vslv (AC). The alternating-current voltage actually applied is not perfectly rectangular as shown in FIG. 3, and has a partially distorted shape.

The thin layer of toner formed on the developing roller 23 by the magnetic brush is conveyed with the rotation of the developing roller 23 to the portion at which the photoconductive drum 1*a* and the developing roller 23 face each other. Since the Vslv (DC) and the Vslv (AC) are applied to the developing roller 23, the toner flies to the photoconductive drum 1*a* with a potential difference between the developing roller 23 and the electrostatic latent image formed on the photoconductive drum 1*a* and the electrostatic latent image on the photoconductive drum 1*a* is developed.

When the rotary sleeve 22*a* is further caused to rotate clockwise, the magnetic brush is then withdrawn from the surface of the developing roller 23 by the magnetic field in the horizontal direction (roller peripheral direction) that is generated by the conveyance pole 37 having different polarity from the main pale 35 and being adjacent to the main pole 35, and the remaining toner on the developing roller 23 being not used for development is recovered onto the rotary sleeve 22*a* from the developing roller 23. When the rotary sleeve 22*a* is further rotated, since a repulsive magnetic field created by the release pole 38 (developer separation part) and the uptake pole 39 having the same polarity with the release pole 38 of the fixed magnet 22*b*, the developer separates from the rotary sleeve 22*a* inside the developing container 20. After being stirred and conveyed by the second stirring screw 21*b*, the two-component developer is restored to the proper toner concentration and uniformly charged, the magnetic brush is reformed on the rotary sleeve 22*a* with the uptake pole 39, and the developer is conveyed to the position facing the regulating blade 25.

A sheet-shaped backflow prevention member 40 is provided along the entire length in the longitudinal direction (direction perpendicular to the plane of the page on which FIG. 2 is shown) of the magnetic roller 22, upstream side in the rotation direction of the rotary sleeve 22*a* as viewed from the release pole 38. A proximal end portion of the backflow prevention member 40 is fixed to the inside of the developing container 20, and the distal end portion is positioned toward the downstream side in the rotation direction of the rotary sleeve 22*a*.

Figure 4:
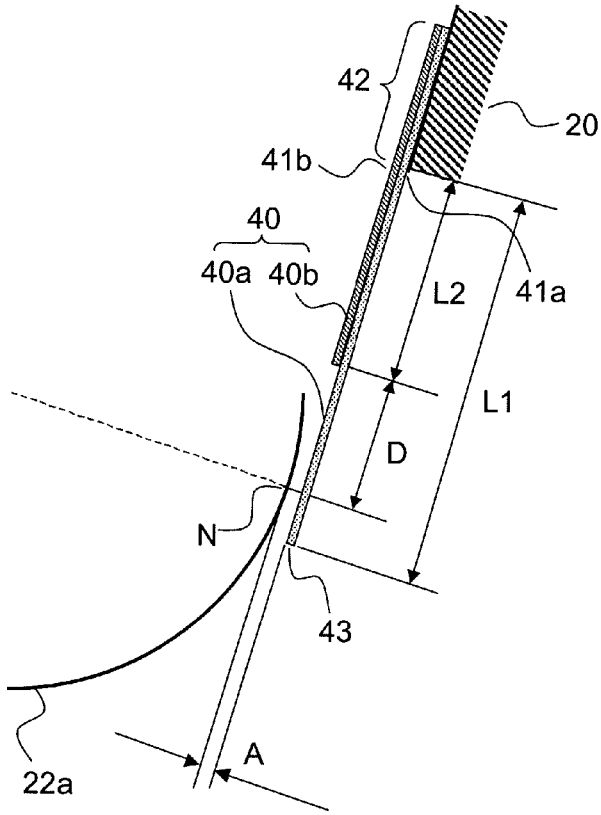
FIG. 4 is a side view showing a backflow prevention member installed in the developing device according to a first embodiment.

FIG. 4 is an enlarged side view showing the relationship between the magnetic roller and the backflow prevention member installed in the developing device according to the first embodiment. The backflow prevention member 40 is composed of a backflow prevention sheet (first sheet member) 40*a* for preventing backflow of the developer inside the second stirring chamber 20*c*, and a reinforcing auxiliary sheet (second sheet member) 40*b* that is overlapped on the side of the proximal end portion 41*a* of the backflow prevention sheet 40*a*. The backflow prevention sheet 40*a* composed of a urethane sheet having a thickness of 0.2 mm is overlapped by a PET film having a thickness of 0.1 mm as the auxiliary sheet 40*b*. A bonding portion 42 fixed to the inside of the developing container 20 is formed by extending the proximal end portion 41*a* of the backflow prevention sheet 40*a* and the proximal end portion 41*b* of the auxiliary sheet 40*b*.

If the regulating blade 25 and the backflow prevention sheet 40*a* cause the first and second stirring chambers 20*b*, 20*c* positioned below the magnetic roller 22 to become nearly closed spaces, there is a possibility that the toner supply may become unstable with risk of the pressure increasing during driving of the first stirring screw 21*a*, second stirring screw 21*b*, and other components. A ventilation path must therefore be provided between the backflow prevention sheet 40*a* and the rotary sleeve 22*a*.

In cases in which the developing device 3*a* is subjected to impact through overturning or dropping of the image-forming apparatus 100 during transport, the backflow prevention sheet 40*a* is pushed by the developer inside the second stirring chamber 20*c* and pushed toward the magnetic roller 22. There is a possibility that the developer may leak from the opening (on the periphery of the developing roller 23) of the developing container 20 at this time when there is a ventilation passage between the backflow prevention sheet 40*a* and the rotary sleeve 22*a*.

Figure 5:
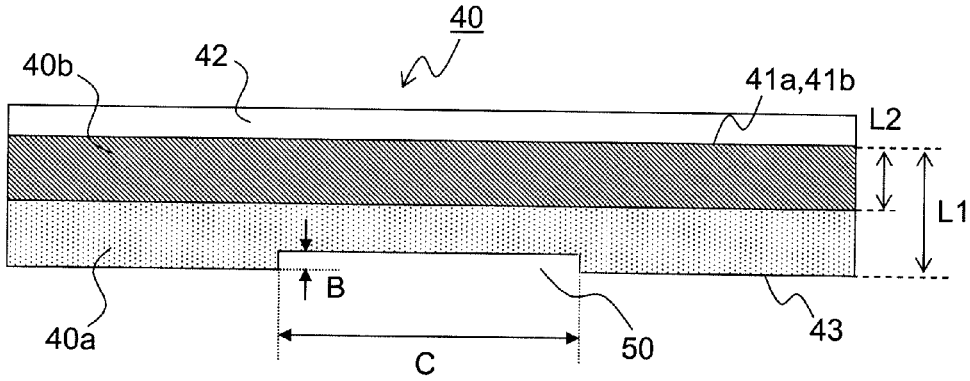
FIG. 5 is a plan view from the side of an auxiliary sheet, showing the backflow prevention member installed in the developing device according to the first embodiment.

FIG. 5 is a plan view from the side of the auxiliary sheet 40*b*, showing the backflow prevention member 40 installed in the developing device according to the first embodiment. In the embodiment, a gap A (see FIG. 4) is provided between the backflow prevention member 40 and the rotary sleeve 22*a*, and a rectangular notch 50 is formed in the distal end portion 43 of the backflow prevention sheet 40*a*.

Figure 6:
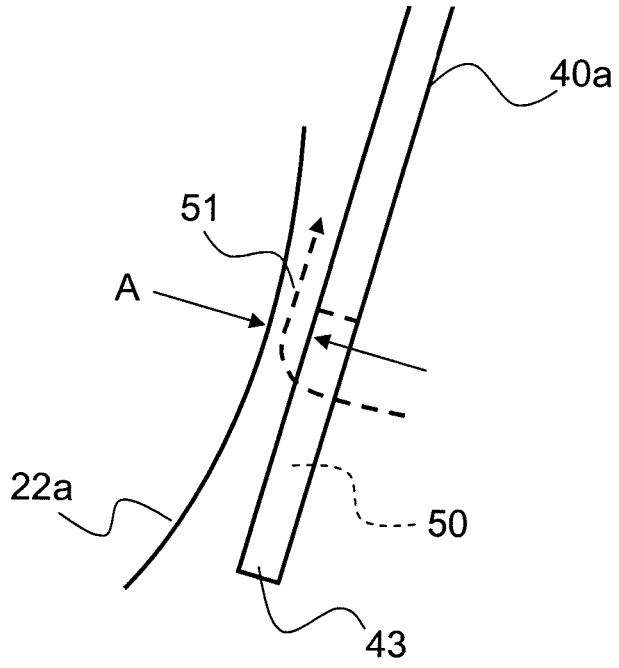
FIG. 6 is an enlarged side view showing the backflow prevention member during driving of the developing device according to the first embodiment.

Through this configuration, the air compressed inside the first and second stirring chambers 20*b*, 20*c* during driving of the developing device 3*a* escapes to the outside through a ventilation path 51 formed by the gap A and the notch 50, as shown in FIG. 6, and an increase in pressure inside the first and second stirring chambers 20*b*, 20*c* can therefore be suppressed. Although not shown in FIG. 6, a developer layer (magnetic brush layer) is formed on the rotary sleeve 22*a* during driving of the developing device 3*a*.

Figure 7:
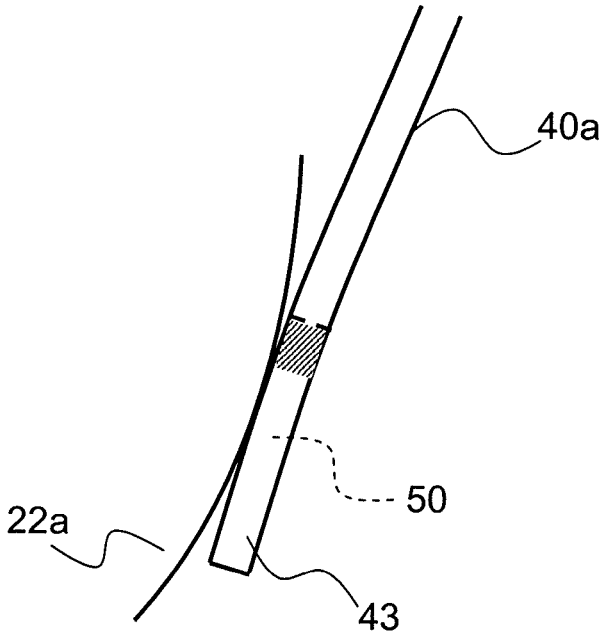
FIG. 7 is an enlarged side view showing a state in which the backflow prevention member is pressed with the developer inside the developing container.

In a case in which the backflow prevention sheet 40*a* is pushed by the developer inside the second stirring chamber 20*c* due to impact during transport of the image-forming apparatus 100, as shown in FIG. 7, the distal end portion 43 of the backflow prevention sheet 40*a* is pressed against the rotary sleeve 22*a*, and the gap A is closed, but the top end portion (region indicated by diagonal lines) of the notch 50 remains unblocked.

When overturning or dropping of the image-forming apparatus 100 causes the developer to clustered on the ends of the developing device 3*a* in the longitudinal direction thereof, the developer readily leaks from the gap between the developing container 20 and the magnetic roller 22. Therefore, by providing the notch 50 substantially at the center in the longitudinal direction of the backflow prevention sheet 40*a* as shown in FIG. 5, leakage of the developer from either end in the longitudinal direction of the developing device 3*a* can be suppressed even when the notch 50 is not completely blocked, as shown in FIG. 7.

Although the effects whereby developer leakage is prevented are enhanced as the depth (dimension in the direction orthogonal to the longitudinal direction) B of the notch 50 decreases, the effects whereby the pressure inside the first and second stirring chambers 20*b*, 20*c* is reduced are diminished, the toner supply becomes unstable, and fogging is prone to occur. On the other hand, the effects whereby the pressure inside the first and second stirring chambers 20*b*, 20*c* is reduced are enhanced as the depth B increases, but the developer is more prone to leak in cases in which the developing device 3*a* is subjected to impact. The depth B of the notch 50 is therefore preferably set to 1 mm or greater and 2 mm or less.

The amount of protrusion of the distal end portion 43 of the backflow prevention sheet 40*a* from the point N of closest approach is not particularly limited, but when there is too little protrusion, the distal end portion 43 of the backflow prevention sheet 40*a* is not adequately pressed against the magnetic roller 22 in cases in which the developing device 3*a* is subjected to impact, and there is a possibility of the developer leaking in cases in which the image-forming apparatus 100 is overturned or dropped and the developing device 3*a* is subjected to impact. The amount of protrusion is therefore preferably 0.5 mm or greater.

Figure 8:
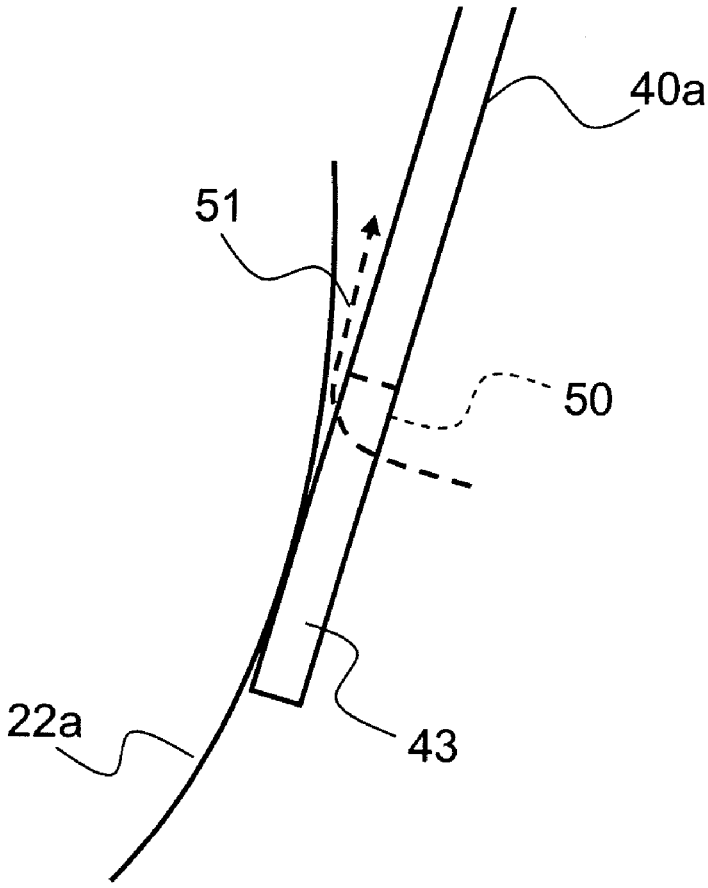
FIG. 8 is a side view showing a configuration in which the backflow prevention member is in contact with the magnetic roller.

A configuration may also be adopted in which a gap A is not provided, and the distal end portion 43 of the backflow prevention sheet 40*a* is brought into contact with the magnetic roller 22. In this case, the ventilation path 51 is formed between the backflow prevention sheet 40*a* and the rotary sleeve 22*a* by the notch 50, as shown in FIG. 8, and the air compressed inside the first and second stirring chambers 20*b*, 20*c* during driving of the developing device 3*a* is released to the outside through the ventilation path 51. In a case in which the backflow prevention sheet 40*a* is pushed by the developer inside the second stirring chamber 20*c*, the notch 50 is blocked except for the top end portion thereof (region indicated by diagonal lines), as same as the case shown in FIG. 7, and leakage of the developer is suppressed. Since the portion in contact with the backflow prevention sheet 40*a* is on the downstream side in the rotation direction of the rotary sleeve 22*a* as viewed from the main pole 35, there is no adverse on formation of the thin layer of toner on the developing roller 23.

The backflow prevention member 40 may also be formed by only the backflow prevention sheet 40*a*, without the use of the auxiliary sheet 40*b*. However, it is preferred that the proximal end portion of the backflow prevention sheet 40*a* is overlapped by the auxiliary sheet 40*b* having a greater elastic modulus than the backflow prevention sheet 40*a*, as in the present embodiment, because the resilience (body) of the backflow prevention member 40 is thereby enhanced, the backflow prevention sheet 40*a* is not readily deformed by the compression force of the developer, and the effects for preventing developer leakage are enhanced.

In a case in which the backflow prevention sheet 40*a* is brought into contact with the rotary sleeve 22*a* as shown in FIG. 8, since there is a possibility of damage to the surface of the rotary sleeve 22*a* when the backflow prevention sheet 40*a* is highly rigid, a low-elastic modulus member made of urethane or the like is preferably used as the backflow prevention sheet 40*a*.

The term "elastic modulus" used in the present specification is a physical property that indicates resistance to deformation, and is a proportionality constant between stress and distortion in elastic deformation. In other words, a material having a higher elastic modulus less readily deforms and has superior resilience.

Figure 9:
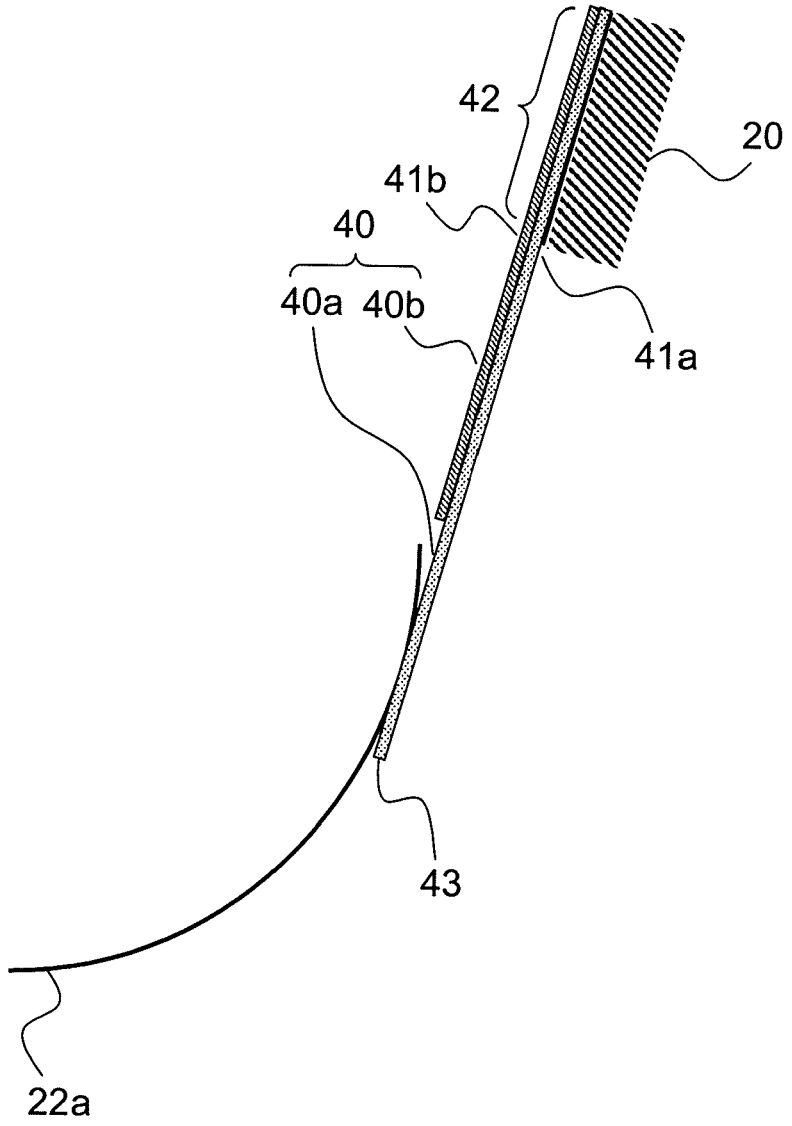
FIG. 9 is a side view showing the backflow prevention member installed in the developing device according to a second embodiment.

FIG. 9 is an enlarged side view showing the relationship between the magnetic roller 22 and the backflow prevention member 40 installed in the developing device according to a second embodiment. Because the structure of the developing device is the same as that of the developing device according to the first embodiment, the descriptions of the developing device is omitted. The backflow prevention member 40*a* is composed of the backflow prevention sheet (first sheet member) 40*a* for preventing backflow of the developer inside the second stirring chamber 20*c*, and a reinforcing auxiliary sheet (second sheet member) 40*b* overlapping on the side of the proximal end portion 41*a* on the outside (the side opposite the second stirring chamber 20*c*) of the backflow prevention sheet 40*a*. In this configuration, a urethane backflow prevention sheet 40*a* having a thickness of 0.2 mm is overlapped by a PET sheet having a thickness of 0.1 mm as the auxiliary sheet 40*b*. A bonding portion 42 fixed to the inside of the developing container 20 is formed by extending the proximal end portion 41*a* of the backflow prevention sheet 40*a* and the proximal end portion 41*b* of the auxiliary sheet 40*b*.

Figure 10:
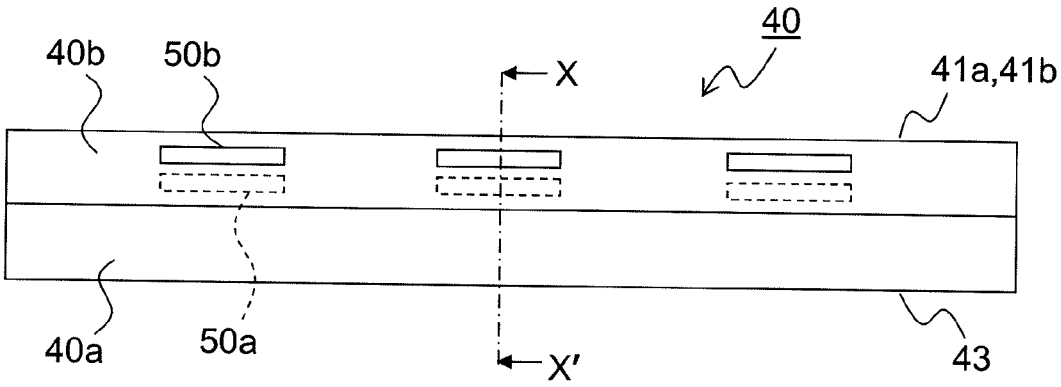
FIG. 10 is a plan view from the side of the auxiliary sheet, showing the backflow prevention member installed in the developing device according to the second embodiment.
Figure 11:
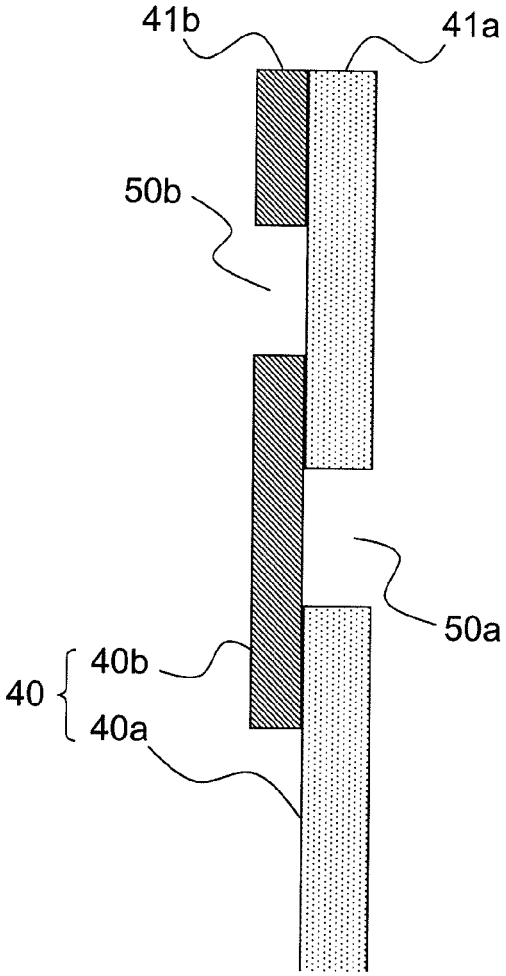
FIG. 11 is an enlarged sectional view showing the overlapping portions of the backflow prevention sheet and the auxiliary sheet in FIG. 10.

FIG. 10 is a plan view from the side of the auxiliary sheet 40*b*, showing the backflow prevention member 40 installed in the developing device according to the second embodiment, and FIG. 11 is an enlarged sectional view (along line XX' in FIG. 10) showing the overlapping portions of the backflow prevention sheet 40*a* and the auxiliary sheet 40*b*. The bonding portion 42 is not shown. As shown in FIGS. 10 and 11, first openings 50*a* and second openings 50*b* are formed in three locations each along the longitudinal direction in the backflow prevention sheet 40*a* and the auxiliary sheet 40*b*, respectively. The first openings 50*a* of the backflow prevention sheet 40*a* and the second openings 50*b* of the auxiliary sheet 40*b* are formed in the same positions in the longitudinal direction (horizontal direction), but are offset from each other with respect to the perpendicular direction.

As shown in FIG. 9, since the distal end portion 43 of the backflow prevention sheet 40*a* is in contact with the surface of the rotary sleeve 22*a*, the developer is held back by the backflow prevention member 40 even when the developing device 3*a* is subjected to impact due to overturning or dropping during transport, and the developer can be prevented from leaking from the open portion (on the periphery of the developing roller 23) of the developing container 20.

In a case in which the backflow prevention sheet 40*a* and the rotary sleeve 22*a* are placed in contact with each other, the spaces inside the first and second stirring chambers 20*b*, 20*c* positioned below the magnetic roller 22 are nearly closed by the regulating blade 25 and the backflow prevention member 40, the pressure increases during driving of the developing device 3*a*, and the toner supply may become unstable. Therefore, by forming the first openings 50*a* in the backflow prevention sheet 40*a* and forming the second openings 50*b* in the auxiliary sheet 40*b* in the present embodiment, the increase in pressure inside the first and second stirring chambers 20*b*, 20*c* is suppressed during driving of the developing device 3*a*.

Figure 12:
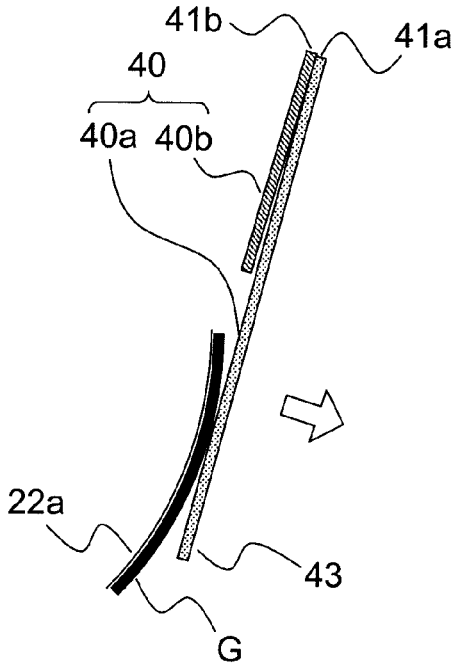
FIG. 12 is an enlarged side view showing the relationship between the backflow prevention member and the magnetic roller during driving of the developing device according to the second embodiment.
Figure 13:
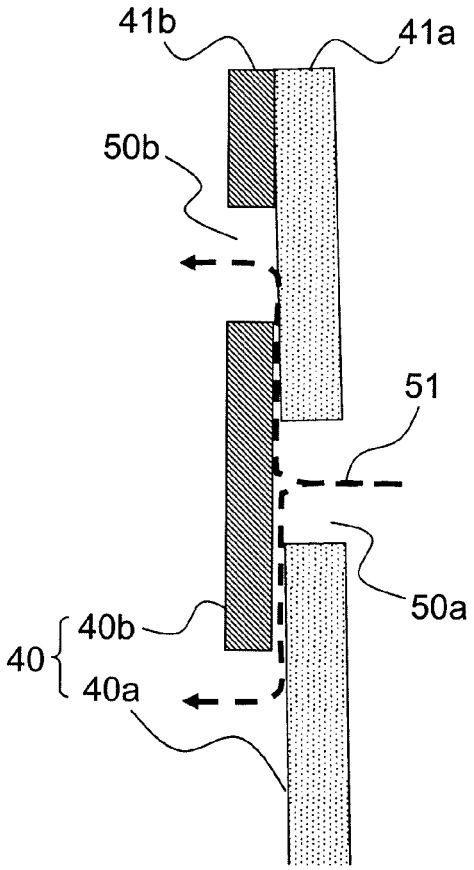
FIG. 13 is an enlarged sectional view showing the overlapping portions of the backflow prevention sheet and the auxiliary sheet in FIG. 12.

FIG. 12 is an enlarged side view showing the relationship between the backflow prevention member 40 and the magnetic roller 22 during driving of the developing device according to the second embodiment, and FIG. 13 is an enlarged sectional view showing the overlapping portions of the backflow prevention sheet 40*a* and the auxiliary sheet 40*b* in FIG. 12. As was also the case in FIGS. 10 and 11, the bonding portion 42 is not shown. When the developing device 3*a* is driven, a developer layer (magnetic brush layer) G is formed on the rotary sleeve 22*a*. The backflow prevention sheet 40*a* is therefore lifted toward the second stirring chamber 20*c* (in the direction of the arrow in FIG. 12) an amount commensurate with the thickness of the developer layer G apart from a surface of the rotary sleeve 22*a*. The auxiliary sheet 40*b* overlapping the backflow prevention sheet 40*a* is not in contact with the rotary sleeve 22*a*, and is therefore kept in its original position.

As a result, a gap is formed in the overlapping portion of the backflow prevention sheet 40*a* and auxiliary sheet 40*b*, and a ventilation path 51 (indicated by the dashed-line arrow in FIG. 13) passing through the first openings 50*a* and second openings 50*b* is formed. Consequently, since the air compressed inside the first and second stirring chambers 20*b*, 20*c* during driving of the developing device 3*a* escapes out through the ventilation path 51, the increase in air pressure inside the first and second stirring chambers 20*b*, 20*c* can be suppressed. The portion in contact with the backflow prevention sheet 40*a* is also downstream side in the rotation direction of the rotary sleeve 22*a* as viewed from the main pole 35, and accordingly there is no adverse effect on formation of the thin layer of toner on the developing roller 23.

The developer layer G is not formed on the rotary sleeve 22*a* before the developing device 3*a* is driven, and the backflow prevention sheet 40*a* and auxiliary sheet 40*b* overlap with no gap. Accordingly, there is no possibility of the developer leaking through the first and second openings 50*a*, 50*b* during transport of the image-forming apparatus 100.

An auxiliary sheet 40*b* formed from a material (PET sheet) having a larger elastic modulus than the backflow prevention sheet 40*a* is preferably superposed on the backflow prevention sheet 40*a*, as in the present embodiment, because the resilience (body) of the backflow prevention member 40 is thereby enhanced, the backflow prevention sheet 40*a* is not readily deformed by the pressure of the developer, and the effects for preventing leakage of the developer are enhanced.

Since there is a possibility of damage to the surface of the rotary sleeve 22*a* when the backflow prevention sheet 40*a* in contact with the rotary sleeve 22*a* has high rigidity, a low-elastic modulus member made of urethane or the like is preferably used as the backflow prevention sheet 40*a*.

Figure 14A:
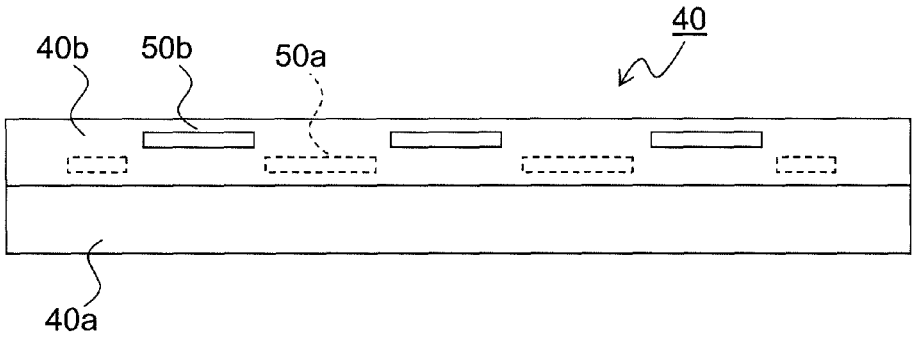
FIG. 14 is a plan view showing another pattern for forming openings in the backflow prevention member installed in the developing device according to the second embodiment.
Figure 14B:
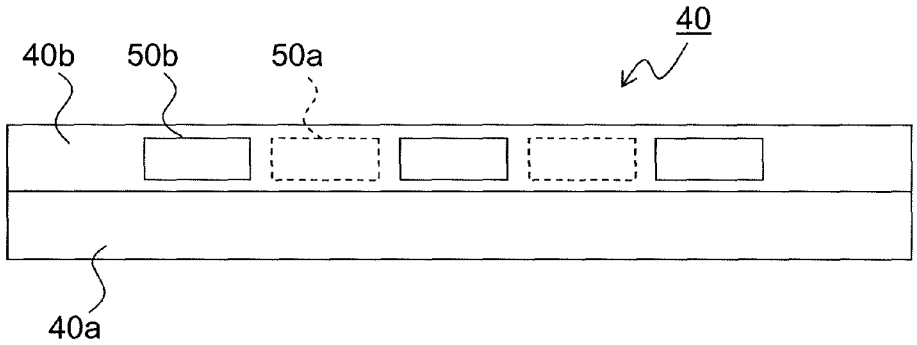

The arrangement of the first and second openings 50*a*, 50*b* is not limited to that of the embodiment described above; the first and second openings 50*a*, 50*b* may be in any positions that do not overlap each other. For example, the openings may be arranged in a zigzag pattern as shown in FIG. 14A, or arranged in alternating fashion in the longitudinal direction as shown in FIG. 14B. The shape, size, and number of the first and second openings 50*a*, 50*b* may be modified as required.

However, when the first and second openings 50*a*, 50*b* are positioned too far away from the proximal end portions 41*a*, 41*b*, the overlapping portions of the backflow prevention sheet 40*a* and the auxiliary sheet 40*b* may separate in the event of impact to the developing device 3*a*, causing the developer to leak. Although depending on the rigidity and the dimensions of the overlapping portions of the backflow prevention sheet 40*a* or the auxiliary sheet 40*b*, the first and second openings 50*a*, 50*b* are preferably formed as close as possible to the proximal end portion 41*a*, 41*b*.

Figure 15:
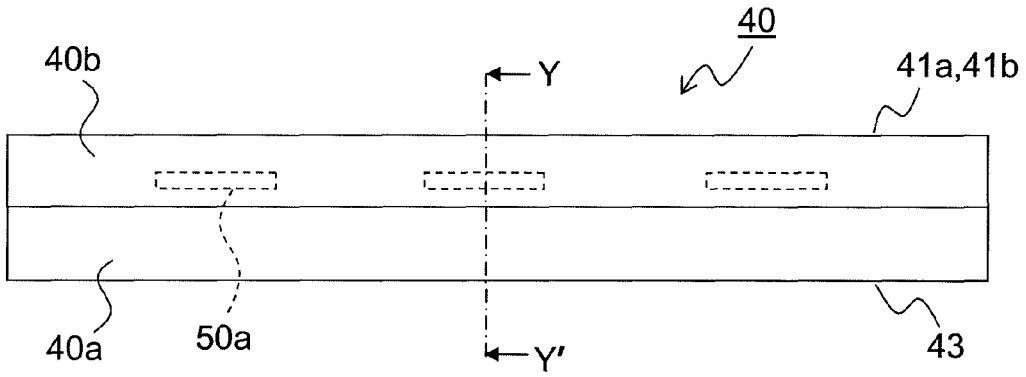
FIG. 15 is a plan view showing another configuration of the backflow prevention member installed in the developing device according to the second embodiment.
Figure 16:
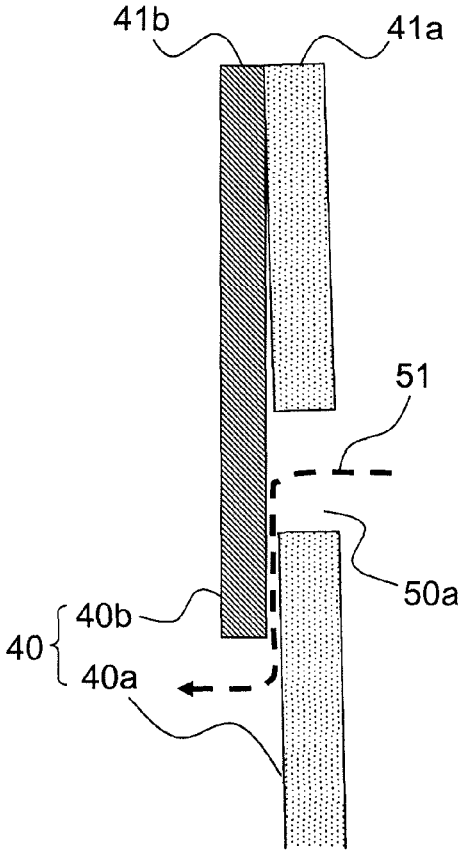
FIG. 16 is an enlarged sectional view showing the overlapping portions of the backflow prevention sheet and the auxiliary sheet during driving of the developing device that uses the backflow prevention member shown in FIG. 15.

FIG. 15 is a plan view showing another example of the structure of the backflow prevention member used in the developing device according to the second embodiment, and FIG. 16 is an enlarged sectional view (along line YY' in FIG. 15) showing the overlapping portions of the backflow prevention sheet 40*a* and the auxiliary sheet 40*b* during driving of the developing device that uses the backflow prevention member shown in FIG. 15. In the example shown in FIGS. 15 and 16, the first openings 50*a* are formed only in the backflow prevention sheet 40*a*, and second openings 50*b* are not formed in the auxiliary sheet 40*b*. The other aspects of this structure are the same as in FIGS. 10 and 11, and will not be described.

In this configuration as well, when the developing device 3*a* is driven, the backflow prevention sheet 40*a* is lifted toward the second stirring chamber 20*c* (in the direction of the arrow in FIG. 12) an amount commensurate with the thickness of the developer layer G formed on the rotary sleeve 22*a* apart from a surface of the rotary sleeve 22*a*. The auxiliary sheet 40*b* overlapping on the backflow prevention sheet 40*a* is not in contact with the rotary sleeve 22*a*, and is therefore kept in its original position. As a result, a gap is formed in the overlapping portion of the backflow prevention sheet 40*a* and auxiliary sheet 40*b* as shown in FIG. 16, and a ventilation path 51 (indicated by the dashed-line arrow in FIG. 16) passing through the gap and the first openings 50*a* is formed.

Consequently, since the air compressed inside the first and second stirring chambers 20*b*, 20*c* during driving of the developing device 3*a* escapes out through the ventilation path 51, the increase in air pressure inside the first and second stirring chambers 20*b*, 20*c* can be suppressed. Since the backflow prevention sheet 40*a* and auxiliary sheet 40*b* overlap with no gap before the developing device 3*a* is driven, there is also no possibility of the developer leaking through the first openings 50*a* during transport of the image-forming apparatus 100.

The first openings 50*a* are preferably formed in positions overlapping the vicinity of the distal end portion of the auxiliary sheet 40*b* so that the ventilation path 51 is easily formed by the lifting of the backflow prevention sheet 40*a*. The shape, size, and number of the first openings 50*a* may also be modified as desired.

Other aspects of the present disclosure are not limited to the embodiments described above; various modifications are possible within the intended scope of the present disclosure. For example, the material and dimensions of the backflow prevention member 40 described in the embodiments above are merely given by way of example, and may be designed as appropriate according to the specifications of the developing device. The backflow prevention member 40 may also be composed of three or more sheets of different materials.

Figure 17:
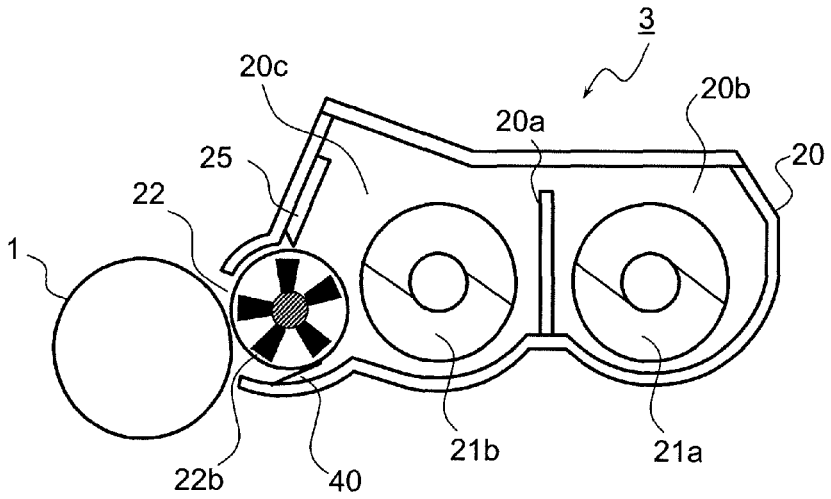
FIG. 17 is a sectional side view showing an example of another configuration of the developing device according to an embodiment.

The present disclosure is also not limited to a developing device provided with a magnetic roller 22 and a developing roller 23 such as shown in FIG. 2, and may be applied in precisely the same manner as a mechanism for preventing leakage of the developer of a developing device 3 for forming a magnetic brush composed of a toner component and a magnetic carrier on a magnetic roller 22 in whose interior is provided a fixed magnet 22*b*, and developing an electrostatic latent image on a photoconductive drum 1 by bringing the magnetic brush into contact with the photoconductive drum 1, as shown in FIG. 17.

The present disclosure is also not limited to the tandem-type color printer shown in FIG. 1; it can be applied to digital or analog monochrome photocopying machines, monochrome printers and rotary developing-type color printers, color photocopying machines, facsimile machines, and a variety of other image-forming apparatuses provided with a two-component developing device. The effects of the present disclosure will next be described in further detail by examples.

[Experiment 1]

An investigation was conducted into the relationship between the dimensions of the notch 50 formed in the backflow prevention member 40 and the occurrence of fogging and developer leakage in a test machine shown in FIG. 1 that was equipped with the developing device according to the first embodiment of the present disclosure shown in FIG. 2. Testing was conducted in a cyan image forming unit Pa that included the photoconductive drum 1*a* and the developing device 3*a*.

In the test machine, the image forming rate was 35 pages/minute, the peripheral speed of the photoconductive drum 1*a* was 240 mm/second, about the surface potential of the photoconductive drum 1*a*, a blank-portion potential (V0) was 300 V, and the image-portion potential (VL) was 20 V. The developing roller 23 and the magnetic roller 22 were 20 mm in diameter, the peripheral speed ratio of the developing roller 23 with respect to the photoconductive drum 1*a* was 1.5 (forward rotation of the surface opposite the photoreceptor), and the peripheral speed ratio of the magnetic roller 22 with respect to the developing roller 23 was 1.5 (counter-rotation of the surface opposite the developing roller). The gap between the photoconductive drum 1*a* and the developing roller 23 was 0.15 mm, and the gap between the magnetic roller 22 and the developing roller 23 was 0.3 mm. The fixed magnet 22*b* was fixed inside the magnetic roller 22 so that the main pole 35 was placed at a position 10° downstream side in the rotation direction of the rotary sleeve 22*a* from the point of closest approach between the magnetic roller 22 and the developing roller 23, and the magnetic attraction of the main pole 35 was 70 mT.

A two-component developer composed of a positively charged toner having an average particle diameter of 6.8 μm and a specific gravity of 1.2, and a coated ferrite carrier having an average particle diameter of 35 μm and a specific gravity of 4.5 was used as the developer, and the mixture ratio (T/C) of toner to carrier was 9 wt %.

Voltage was applied to the developing roller under the following conditions: Vslv (DC)=50 V; Vpp of Vslv (AC): 1.5 kV; frequency: 3 kHz; and duty ratio=35%. Voltage was applied to the magnetic roller under the following conditions: Vmag (DC)=250 V; Vpp of Vmag (AC): 1.4 kV; frequency: 3 kHz; and duty ratio=65%.

Evaluation was carried out by the following method. Using a backflow prevention member 40 such as the one shown in FIG. 4, in which an auxiliary sheet 40*b* having a length L2 of 7 mm from the proximal end portion 41*b* was overlapped on the proximal end portion 41*a* of a backflow prevention sheet 40*a* having a length L1 of 10.5 mm from the proximal end portion 41*a*, and the distance D from the closest approach point N to the distal end of the auxiliary sheet 40*b* was 3.5 mm, the occurrence of fogging was macroscopically observed after 250,000 printings of a white image (plain white) when the gap A between the backflow prevention member 40 and the rotary sleeve 22*a*, and the depth B and width C of the notch 50 shown in FIG. 5 were varied. Cases in which fogging could not be identified were designated as "○," cases in which some fogging was present but not to a practically problematic degree were designated as "Δ," and cases in which there was a practically problematic degree of fogging were designated as "x."

To evaluate developer leakage, a drop test was conducted in which a packaged test machine in which the developing device was installed was dropped a total of ten times from a height of 60 cm, with one drop each being at the landing sites of a corner (one location), edges (three locations in the length, width, and height directions with a corner at the center), a top surface, side surfaces (four locations), and a bottom surface. The developing device 3*a* was then removed from the test machine, and leakage of the developer was macroscopically observed. Cases of no developer leakage were designated as "○," cases in which some leakage was present but not to a practically problematic degree were designated as "Δ," and cases in which there was a practically problematic degree of leakage were designated as "x." The evaluation results are shown in Table 1 in conjunction with the values for the gap A, depth B, and width C. Table 2 shows the results obtained when using a backflow prevention member 40 that was composed only of the backflow prevention sheet 40*a* without the auxiliary sheet 40*b*.

TABLE 1

| | A value [mm] | B value [mm] | C value [mm] | Fogging | Developer leakage |
|---|---|---|---|---|---|
| Example 1 | 0.5 | 1 | 60 | Δ | ○ |
| Example 2 | 0.5 | 2 | 60 | ○ | Δ |
| Example 3 | 0.5 | 2 | 40 | ○ | Δ |
| Example 4 | 0 | 1 | 60 | Δ | ○ |
| Example 5 | 0 | 2 | 60 | ○ | Δ |
| Comparative Example 1 | 0.5 | 0 | 0 | X | ○ |
| Comparative Example 2 | 0 | 0 | 0 | X | ○ |

TABLE 2

| | A value [mm] | B value [mm] | C value [mm] | Fogging | Developer leakage |
|---|---|---|---|---|---|
| Example 6 | 0.5 | 1 | 60 | Δ | Δ |
| Example 7 | 0.5 | 2 | 60 | ○ | Δ |
| Example 8 | 0.5 | 2 | 40 | ○ | Δ |
| Example 9 | 0 | 1 | 60 | Δ | Δ |
| Example 10 | 0 | 2 | 60 | ○ | Δ |
| Comparative Example 3 | 0.5 | 0 | 0 | X | Δ |
| Comparative Example 4 | 0 | 0 | 0 | X | Δ |

As is apparent from Tables 1 and 2, fogging either was not observed or was not present to a practically problematic degree in Example 1 to 10 in which the notch 50 was provided to the backflow prevention member 40. The fogging-suppression effects were particularly significant in Example 2, 3, 5, 7, 8, and 10, in which the depth B of the notch 50 was set to 2 mm. As for leakage of the developer after the drop test, developer either did not leak or leakage was not present to a problematic degree in Example 1 through 10, in which the depth B of the notch 50 was set to 1 mm or 2 mm.

It is furthermore apparent from comparison of Example 1 to 5 and Example 6 to 10 that use of the auxiliary sheet 40*b* further suppressed leakage of the developer during drop testing. The reason for this may be that because the auxiliary sheet 40*b* is highly resilient, the backflow prevention member 40 was not readily deformed by the pressure of the developer, and a gap was not readily formed between the backflow prevention member 40 and the rotary sleeve 22*a*.

In contrast, in Comparative Examples 1 to 4 in which the notch 50 was not provided to the backflow prevention member 40, although developer leakage was absent or not present to a practically problematic degree, severe fogging occurred. The image forming unit Pa for cyan was tested in this case, but the same effects were also confirmed for the magenta, yellow, and black image forming units Pb,Pc and Pd.

[Experiment 2]

An investigation was conducted into the relationship between the positioning of the first and second openings 50*a*, 50*b* formed in the backflow prevention member 40 and the occurrence of fogging and developer leakage in a test machine shown in FIG. 1, equipped with the developing device according to the second embodiment shown in FIG. 2. Testing was conducted in a cyan image forming unit Pa that included the photoconductive drum 1*a* and the developing device 3*a*. The two-component developer and the conditions of voltage application to the developing roller 23 and the magnetic roller 22 were the same as in Experiment 1.

Figure 18:
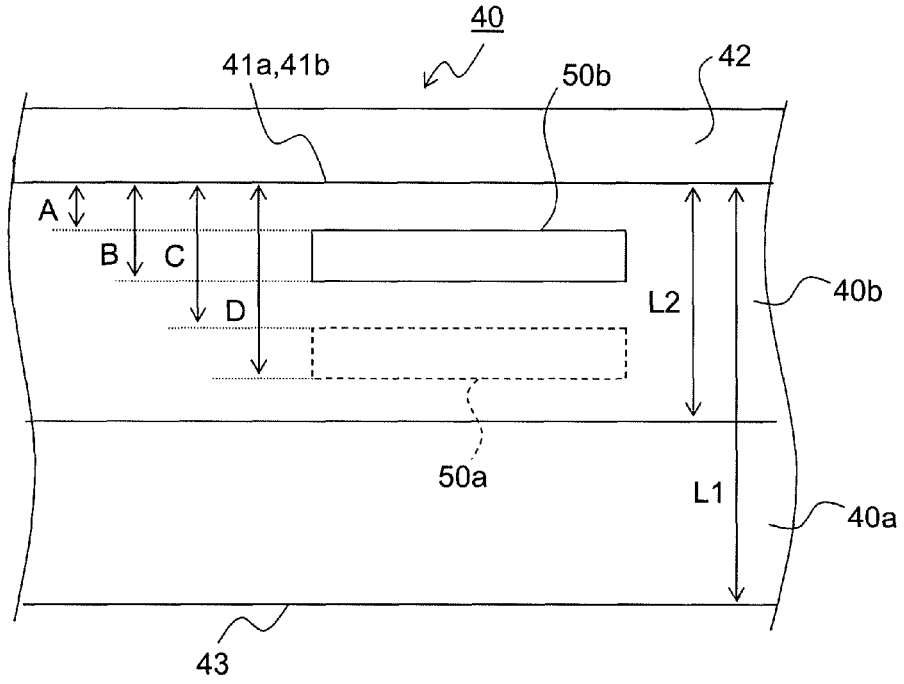
FIG. 18 is an enlarged view showing the positional relationship between the first and second openings in examples.

Evaluation was carried out by the following method. As shown in FIG. 18, using a length L1 of 10.5 mm from the proximal end portion 41*a* of the backflow prevention sheet 40*a*, a length L2 of 5.5 mm from the proximal end portion 41*b* of the auxiliary sheet 40*b*, and a length of 3 mm of the bonding portion 42, the occurrence of fogging was macroscopically observed after 250,000 printings of white image (plain white) when the following distances from the proximal end portion 41 as the bonding reference position of the backflow prevention member 40 were varied: the distance A to the top end of the first openings 50*a*, the distance B to the bottom end of the first openings 50*a*, the distance C to the top end of the second openings 50*b*, and the distance D to the bottom end of the second openings 50*b*. Cases in which fogging could not be identified were designated as "○," cases in which some fogging was present but not to a practically problematic degree were designated as "Δ," and cases in which there was a practically problematic degree of fogging were designated as "x."

To evaluate developer leakage, a drop test was conducted in which a packaged test machine in which the developing device was installed was dropped a total of ten times from a height of 60 cm, with one drop each being at the landing sites of a corner (one location), an edge (three locations in the length, width, and height directions with a corner at the center), the top surface, a side surface (four locations), and the bottom surface. The developing device 3*a* was then removed from the test machine, and leakage of the developer was macroscopically observed. Cases of no developer leakage were designated as "○," cases in which some leakage was present but not to a practically problematic degree were designated as "Δ," and cases in which there was a practically problematic degree of leakage were designated as "x." The evaluation results are shown in Table 3 in correlation with the values for the distances A, B, C, and D.

TABLE 3

| | A value [mm] | B value [mm] | C value [mm] | D value [mm] | Fogging | Developer leakage |
|---|---|---|---|---|---|---|
| Example 11 | 0 | 1 | 2 | 3 | ○ | ○ |
| Example 12 | 1 | 2 | 3 | 4 | ○ | ○ |
| Example 13 | 0 | 1.5 | 2 | 3.5 | ○ | ○ |
| Comparative Example 5 | | | No openings | | X | ○ |

As is apparent from Table 3, fogging was not observed Example 11 and 12 in which first and second openings 50*a*, 50*b* having a width of 1 mm were provided 1 mm apart, or in Example 13 in which first and second openings 50*a*, 50*b* having a width of 1.5 mm were provided 0.5 mm apart. There was also no leakage of developer observed after the drop test.

In contrast, in Comparative Example 5 in which the first and second openings 50*a*, 50*b* were not formed, fogging was severe despite the absence of developer leakage. The image forming unit Pa for cyan was tested in this case, but the same effects were also confirmed for the magenta, yellow, and black image forming units Pb,Pc and Pd.

The examples described above represent only an example of the configuration of the present disclosure; the surface potential of the photoconductive drum 1*a*, the conditions of voltage application to the developing roller 23 and magnetic roller 22, and other characteristics may be set as appropriate according to device specifications or usage environment.

According to the present disclosure, since increases in pressure inside the developing container are suppressed by the ventilation path formed between the developer bearing member and the backflow prevention member, and the supply of toner is stabilized, it is possible to reduce the occurrence of fogging due to defects in toner charging.

What is claimed is:

1. A developing device comprising:

a developing container configured to accommodate a two-component developer that includes a toner and a magnetic carrier;

a stirring/conveyance member configured to stir and convey the developer accommodated in the developing container;

a developer bearing member configured to bear and convey the developer, the developer bearing member being provided so as to be able to rotate above the stirring/conveyance member;

a fixed magnet configured to have a plurality of magnetic poles that includes a release pole for releasing the developer from a surface of the developer bearing member, the fixed magnet being fixed to the inside of the developer bearing member;

a regulating blade configured to be disposed facing the developer bearing member so as to be downstream in the direction of rotation of the developer bearing member as viewed from the release pole; and a backflow prevention member that is a sheet-shaped member configured to be disposed along the entire length in the longitudinal direction of the developer bearing member so as to be upstream in the direction of rotation of the developer bearing member as viewed from the release pole, the backflow prevention member being disposed so that a proximal end portion thereof is fixed to an inside surface of the developing container, and a distal end portion thereof is in contact with or adjacent to the developer hearing member and facing downstream in the direction of rotation of the developer bearing member, wherein a notch is formed in the distal end portion of the backflow prevention member.

2. The developing device according to claim 1, wherein the backflow prevention member is formed by stacking a plurality of sheets of different materials.

3. The developing device according to claim 2, wherein the backflow prevention member comprises a first sheet member, a proximal end portion thereof being fixed to the developing container, and a distal end portion thereof being disposed in contact with or adjacent to the developer bearing member; and a second sheet member that overlaps on a proximal end side of the first sheet member and has a greater elastic modulus than the first sheet member.

4. The developing device according to claim 3, wherein the notch is formed in a rectangular shape in the longitudinal direction of the backflow prevention member, and the dimension of the notch in the direction orthogonal to the longitudinal direction is 1 mm or greater and 2 mm or less.

5. The developing device according to claim 4, wherein the amount of protrusion of the distal end portion of the backflow prevention member from the point of closest approach between the developer bearing member and the backflow prevention member is 0.5 mm or greater.

6. The developing device according to claim 4, wherein the notch is formed substantially at the center in the longitudinal direction of the backflow prevention member.

7. The developing device according to claim 2, wherein the notch is formed in a rectangular shape in the longitudinal direction of the backflow prevention member, and the dimension of the notch in the direction orthogonal to the longitudinal direction is 1 mm or greater and 2 mm or less.

8. The developing device according to claim 7, wherein the amount of protrusion of the distal end portion of the back flow prevention member from the point of closest approach between the developer bearing member and the backflow prevention member is 0.5 mm or greater.

9. The developing device according to claim 7, wherein the notch is formed substantially at the center in the longitudinal direction of the backflow prevention member.

10. The developing device according to claim 1, wherein the notch is formed in a rectangular shape in the longitudinal direction of the backflow prevention member, and the dimension of the notch in the direction orthogonal to the longitudinal direction is 1 mm or greater and 2 mm or less.

11. The developing device according to claim 10, wherein the amount of protrusion of the distal end portion of the backflow prevention member from the point of closest approach between the developer bearing member and the backflow prevention member is 0.5 mm or greater.

12. The developing device according, to claim 10, wherein the notch is formed substantially at the center in the longitudinal direction of the backflow prevention member.

13. The developing device according to claim 1, wherein the backflow prevention member comprises a first sheet member and a second sheet member that overlaps on an upstream side in the rotation direction of the developer bearing member with respect to the first sheet member, only the distal end portion of the first sheet member is in contact with the developer bearing member, and at least one opening is formed in the first sheet member in a portion that overlaps with the second sheet member.

14. The developing device according to claim 13, wherein at least one opening is formed in the second sheet member in a position not overlapping with the opening formed in the first sheet member.

15. The developing device according to claim 14, wherein the second sheet member has a greater elastic modulus than the first sheet member.

16. The developing device according to claim 13, wherein the second sheet member has a greater elastic modulus than the first sheet member.

17. An image-forming apparatus equipped with the developing device according to claim 13.

18. An image-forming apparatus equipped with the developing device according to claim 1.

* * * * *